US008952278B2

(12) United States Patent
Eriksson et al.

(10) Patent No.: US 8,952,278 B2
(45) Date of Patent: Feb. 10, 2015

(54) INTERLOCKING MECHANISM FOR SWITCHING DEVICES

(71) Applicants: Anders Eriksson, Vasteras (SE); Lars Eriksson, Vasteras (SE)

(72) Inventors: Anders Eriksson, Vasteras (SE); Lars Eriksson, Vasteras (SE)

(73) Assignee: ABB AB (SE)

( * ) Notice: Subject to any disclaimer, the term of this patent is extended or adjusted under 35 U.S.C. 154(b) by 0 days.

(21) Appl. No.: 14/275,420

(22) Filed: May 12, 2014

(65) Prior Publication Data

US 2014/0246295 A1 Sep. 4, 2014

Related U.S. Application Data

(63) Continuation of application No. PCT/EP2011/070326, filed on Nov. 17, 2011.

(51) Int. Cl.

| | |
|---|---|
| ***H01H 1/20*** | (2006.01) |
| ***H01H 9/20*** | (2006.01) |
| ***H01H 9/26*** | (2006.01) |
| ***H01H 33/52*** | (2006.01) |

(52) U.S. Cl.
CPC *H01H 9/26* (2013.01); *H01H 33/52* (2013.01)
USPC ..... 200/50.32; 200/50.33

(58) Field of Classification Search
USPC ..... 200/5 B, 5 EA, 50.01, 50.32–50.35, 334; 361/605, 615
See application file for complete search history.

(56) References Cited

U.S. PATENT DOCUMENTS

| | | | | | |
|---|---|---|---|---|---|
| 4,883,927 | A | * | 11/1989 | Apfelbacher et al. | 200/50.33 |
| 4,924,041 | A | * | 5/1990 | Yee | 200/50.33 |
| 5,008,499 | A | | 4/1991 | Yee et al. | |
| 6,002,579 | A | * | 12/1999 | Drexler et al. | 361/605 |

OTHER PUBLICATIONS

International Search Report and Written Opinion of the International Searching Authority Application No. PCT/EP2011/070326 Completed: Jul. 13, 2012; Mailing Date: Jul. 20, 2012 11 pages.

* cited by examiner

*Primary Examiner* — Renee Luebke
*Assistant Examiner* — Lheiren Mae A Caroc
(74) *Attorney, Agent, or Firm* — St. Onge Steward Johnston & Reens LLC

(57) ABSTRACT

An interlocking mechanism for interlocking a first and a second low voltage switching devices, wherein each of the switching devices includes a movable contact part, a stationary contact part and, an actuating unit for operating the movable contact part in a direction and making connection or disconnection with the stationary contact part. The interlocking mechanism includes a first and a second housing connected to each other, a first and a second sliding bar. The first sliding bar is arranged on the first housing and connects to the actuating unit of the first switching device. The second sliding bar is arranged on the second housing and connects to the actuating unit of the second switching device. A sliding plane is defined and has a X- and Y-axis, the Y-axis being defined in the direction of motion of the actuating unit of the switching devices.

11 Claims, 4 Drawing Sheets

INTERLOCKING MECHANISM FOR SWITCHING DEVICES

FIELD OF THE INVENTION

The present invention relates to an interlocking mechanism for mechanically locking one of two low-voltage switching devices when the other switching device is in a closed position, wherein the two switching devices are placed side by side. Each of the switching devices comprises a movable contact part, a stationary contact part and, an actuating unit for operating the movable contact part in a direction and making connection or disconnection with the stationary contact part. The interlock is connected to the actuating unit. In particular, the invention relates to a mechanical interlock. Such a switching device may be arranged to operate a low voltage application, wherein the low-voltage is in a range of 1000 V AC or 1500 V DC.

BACKGROUND OF THE INVENTION

Depending on the requirement of an application, it is sometimes required to connect an electrical device to the same power source via two switching devices or contacting devices. In this case, it is important to provide reliable power to the electrical device. Therefore, an interlock mechanism is provided when the switching devices are used, which means that the switching devices won't be closed simultaneously for avoiding short-circuiting connected electrical devices.

FIG. 6 illustrates a perspective view of a mechanical interlock for interlocking a first and second switching devices according to the prior art, wherein the interlocking mechanism comprising a first and a second housing 60, 60' connected to each other. The moving contact parts of the switching devices are movable between open and closed positions. A first and a second sliding bar 610, 610' are arranged on the first housing and second housing respectively and are further connected to the corresponding actuating unit of each of the switching devices. The sliding bars are arranged to slide along a sliding plane defined by an X'- and Y-axis. The Y-axis is defined in the direction of motion of the actuating unit of the switching devices and each of the sliding bars is configured to slide in the Y-axis direction of the sliding plane. The interlock further includes a shaft and a cam integrated with the shaft as one piece 640. This integrated part is disposed between the first and second housing and the cam is configured to be only rotatable when both switching devices are in open position. Furthermore, the cam is adapted, following the motion of the actuating unit and thereby the movable contact part of the first switching device, to rotate to a position wherein for retaining the second switching devices in an open position.

This type of an interlock requires the housings be well connected during operations. During their life, switching devices may however make numerous contacting operations, each of which results a rotation of the cam. The rotations however result in frictions between the shaft-cam assemble and the housings, which consequently results displacement between the housings. This may result in simultaneous closure of both of the switching devices, which consequently results a short-circuit fault. Therefore, a more reliable interlock is desired.

SUMMARY OF THE INVENTION

One object of the present invention is to provide an improved interlocking mechanism for locking out one of two switching devices when the other is in a closed position, which is reliable, compact, easily to be installed.

This object is achieved by the interlocking mechanism, characterized in that the shaft is disposed to be perpendicular to the sliding plane so that the shaft is perpendicular to the direction of motion of the actuating unit of the switching devices, the cam further comprises a first and a second locking element for blocking the first and second sliding bar respectively, each of the locking elements protruding laterally in the X-axis direction, each of the sliding bars comprises an opening at one end of the bar, and the opening is configured for retaining the corresponding locking element when the corresponding switching device is in a closed position.

By disposing the shaft perpendicularly to the sliding plane and adapting the structures of the cam and sliding bars to it, the present invention solves the aforesaid problem. Because the rotating motion of the cam has been changed in another dimension with 90°, the frictions between the shaft-cam assemble and the housings during operations have been significantly reduced, which further reduces the displacement between the housings. Therefore, the invention prevents the switching devices from being short-circuited, which enables a safer and more reliable operation.

Another advantage is that the invention extends the lifetime of the interlock. This is because that, due to disposing the shaft perpendicularly to the sliding plane, a contacting force generated by a connecting operation of a switching device becomes more centered on the shaft, which further reduces the wear of the housing.

According to one embodiment of the invention, the cam is mountable on the shaft. Alternatively, the cam is formed with the shaft as one piece. A holder may be provided on the first and second housing respectively for retaining the shaft.

According to another embodiment of the invention, the cam has a curved outline. It is advantageous to provide a curved outline in that this optimized shape saves space between the first and second housing, which enables a compact interlocking mechanism. Preferably, the curved outline is arc-shaped.

When in use, such an interlocking mechanism may be arranged between the first and the second switching devices that have the same size.

By providing a third housing arranged between the first and second housings and adapting the first sliding bar to the size of the first switching device, the interlocking mechanism may be applied to the first and the second switching devices of different size.

According to yet another embodiment of the invention, the first and second housing may further respectively comprise a sliding track and the corresponding sliding bar is arranged to slide thereon.

BRIEF DESCRIPTION OF THE DRAWINGS

The invention will now be explained more closely by the description of different embodiments of the invention and with reference to the appended figures.

DETAILED DESCRIPTION OF THE INVENTION

Figure 1:
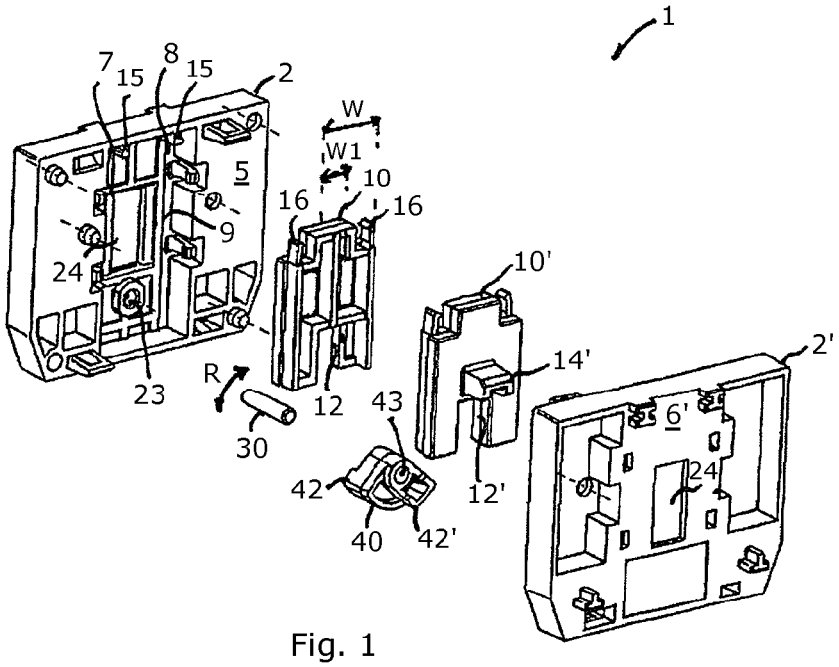
FIG. 1 shows an exploded view of an interlock mechanism, according to a first embodiment of the invention.
Figure 1A:
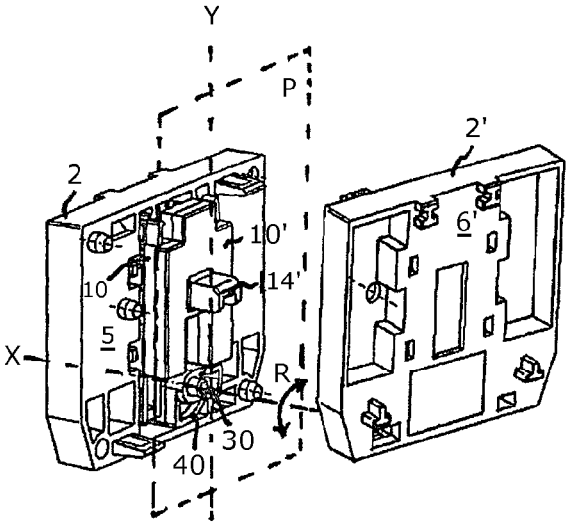
FIG. 1A shows a perspective view of the half-assembled interlock mechanism shown in FIG. 1.
Figure 1B:
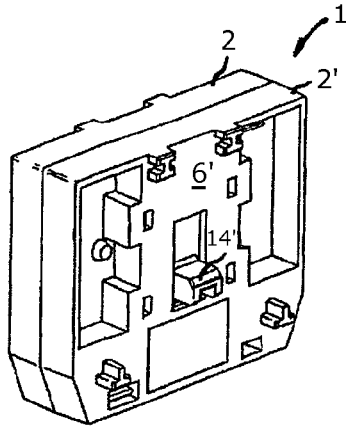
FIG. 1B shows a perspective view of the completely assembled interlock mechanism shown in FIG. 1.

With reference to FIG. 1, 1*a-b* and FIG. 2, an interlocking mechanism 1 for interlocking a first 200 and a second 200' switching devices comprises a first 2 and a second 2' housing connected to each other, a first 10 and a second 10' sliding bar, a shaft 30 disposed between the first 2 and the second 2' houses and a cam 40 configured to be rotatable about the shaft 30. Each of the housing 2, 2' has an inner side 5, 5' and an outer side 6, 6' and the first and the second housing 2, 2' are connected with their inner sides against to each other.

Each of the switching devices 200, 200' may comprise a movable contact part, a stationary contact part and an actuating unit (they are not shown) for operating the movable contact part in a direction and making connection or disconnection with the stationary contact part.

The first sliding bar 10 is arranged on the inner side 5 of the first housing 2 and connecting to the actuating unit of the first switching device 200 and the second sliding bar 10' is arranged on the inner side 5' of the second housing 2' and connecting to the actuating unit of the second switching device 200'. In this example, a recess 9, 9' is provided in the inner side 5, 5' of each of the housing 2, 2' for retaining the corresponding sliding bar 10, 10'. A sliding plane P is defined and has an X- and Y-axis, wherein the Y-axis is defined in the direction of motion of the movable parts of the switching devices. Each of the sliding bars 10, 10' are configured to slide in the Y-axis direction of the sliding plane P. A sliding track 7, 8 may be further provided in the recess 9 of a housing 2 for facilitating the sliding motion of the sliding bar 10.

Moreover, an actuating connector 14, 14' is provided on each of the sliding bars 10, 10' for connecting the sliding bar 10, 10' to the actuating unit of the corresponding switching device 200, 200'. An opening 24, 24' is further provided on each of the recesses 9, 9' to allow the actuating connector 14, 14' to extend therethrough. Therefore, as the movable contact part of the switching device 200, 200', the sliding bars 10, 10' are also operated by the actuating unit.

A holder, in this example in form of a recess 23, 23', is further provided on the inner side of a housing 2, 2' for retaining the shaft 30. The shaft 30 is disposed to be perpendicular to the sliding plane P, which therefore means that the shaft 30 is perpendicular to the direction of motion of the actuating unit of the switching devices 200, 200'.

It is advantageous that the shaft 30 is arranged to be perpendicular to the sliding plane P, it is possible to make a form bound measurement in a molding tool to be used to make the recess 23, 23'. The form bound measurement in the molding tool enables a more accurate recess and reduces the gap between the shaft and the recess.

Furthermore, to prevent simultaneous closure of the switching devices 200, 200', the cam 40 is configured to be only rotatable about the shaft 30 when both switching devices 200, 200' are in open positions.

Figure 5A:
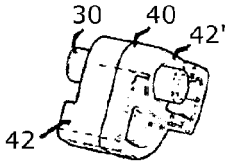
FIG. 5A shows a perspective view of the shaft and the cam of the interlock mechanism shown in FIG. 1.
Figure 5B:
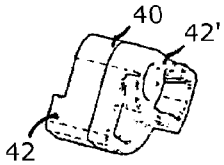
FIG. 5B shows a perspective view of the cam of the interlock mechanism shown in FIG. 1.
Figure 5C:
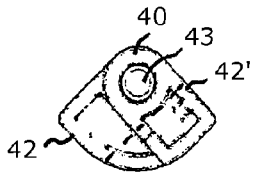
FIG. 5C shows a plan view of the cam of the interlock mechanism shown in FIG. 1.

With reference to FIG. 5*a-c*, the cam 40 includes two sides opposite to each other. A first and a second locking element 42, 42' are further provided on each of the sides of the cam 40 and is protruding laterally in the X-axis direction. The cam may be rotatable about the shaft in a range of 80°-100°, preferably about 90° in the direction of the X-axis, or R. In this example, the cam 40 is mountable on the shaft 30. In this case, a through hole 43 is provided on the cam 40. Alternatively, the cam may be formed with the shaft as one piece. The cam and shaft may be made of metal, for example steel, and/or hard plastics.

In this example, the cam 30 has a curved outline so that the cam may rotate in a relatively small space, a compact interlock is therefore achieved. Preferably, the curved outline is arc-shaped. It should be understood that other structures of a cam may be applicable to the invention.

Furthermore, an opening 12, 12' is provided at one end of each of the sliding bars 10, 10' for retaining the corresponding locking element 42, 42' when the corresponding switching device is in a closed position. The opening has a width W arranged to be able to retain the cam. In this example, the opening 12 further comprises an outer portion 15 facing the housing 2 and has a smaller width $W_1$ than W. The outer portion is further configured to retain the locking element 42 when the corresponding switching device 200 is in a closed position.

Figure 5D:
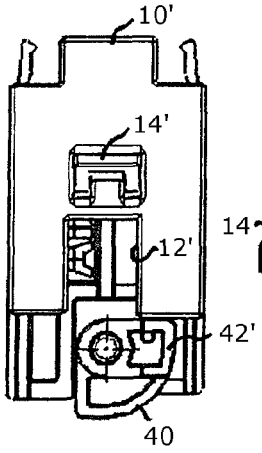
FIGS. 5D-5G show perspective views of how the sliding bar and the cam interact to each other when an operation status of a switching device transforms from an open position to a closed position.
Figure 5E:
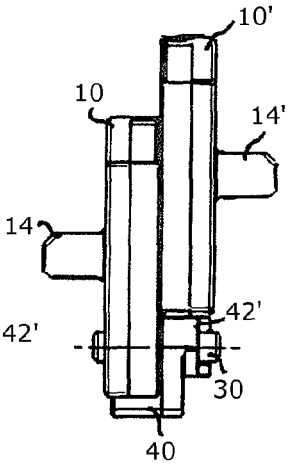

FIG. 5*d-e* show a plan and a side view of the interlock 1 in an interlocking position, where the first switching device 200 is in a closed position and the second locking element 42' is blocking the second sliding bar 10' to prevent the second switching device 200' from a connecting operation.

Figure 5F:
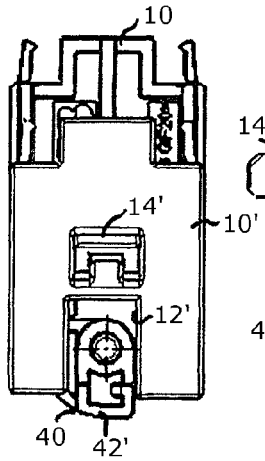
Figure 5G:
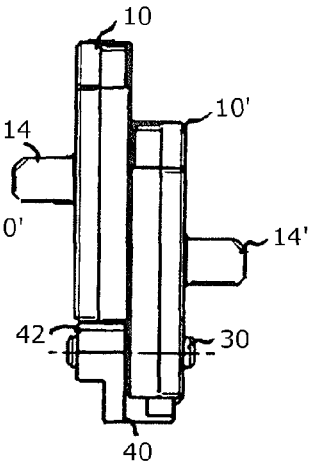

With reference to FIG. 5*f-g*, following a connecting/closing operation of the second switching device 200', the second sliding bar 10' is actuated by the actuating unit and moves towards a closed position. The motion of the second sliding bar 10' is further transformed to a rotating motion of the cam 40 so that the cam 40 rotates to a position wherein the second locking element 42' is retained in the outer portion of the opening 12' whereas the first locking element 42 is blocking the first sliding bar 10 to prevent the first switching device 200 from a connecting/closing operation.

In this example, the first and second locking elements 42, 42' are disposed to be perpendicular to each other. However, other dispositions of the locking elements may be also possible.

Figure 2:
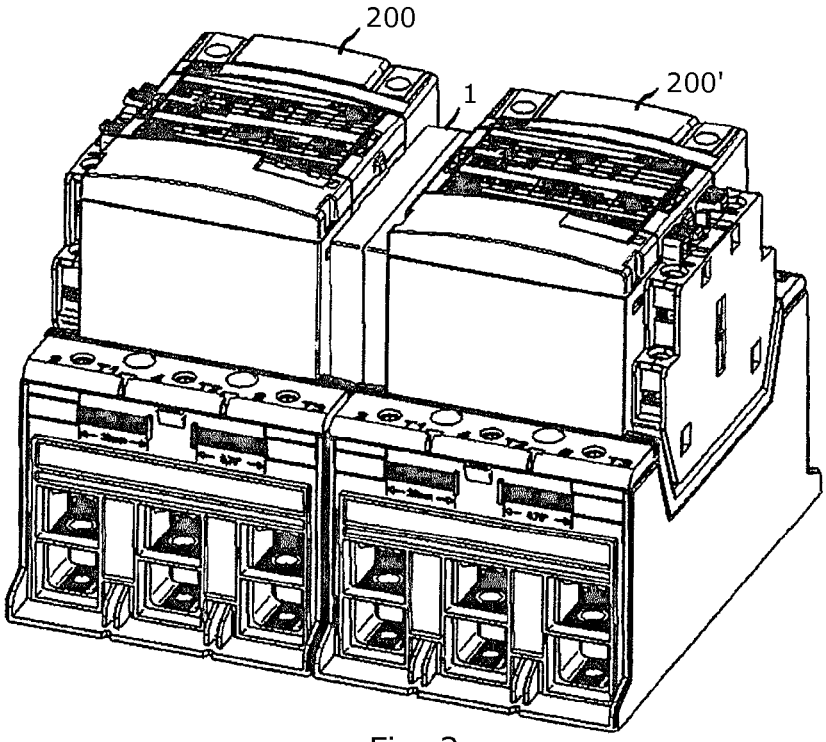
FIG. 2 shows a perspective view of two identical switching devices with the interlock mechanism shown in FIG. 1 mounted between these two devices.
Figure 6:
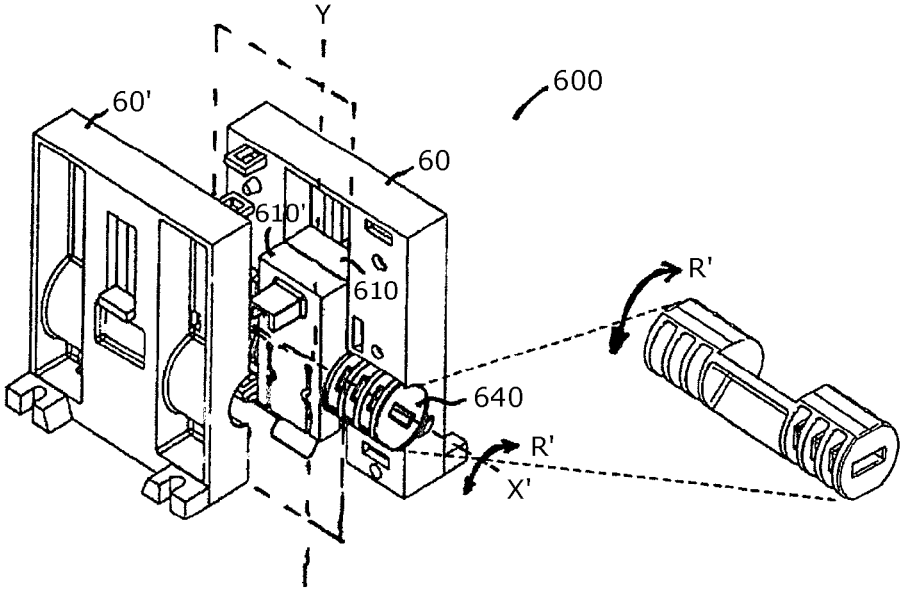
Fig. 6 (prior art)
FIG. 6 shows a perspective view of an interlock of a prior art.

As shown in FIG. 2, when in use, such an interlocking mechanism may be arranged between two identical switching devices 200, 200' that have the same size.

Figure 3:
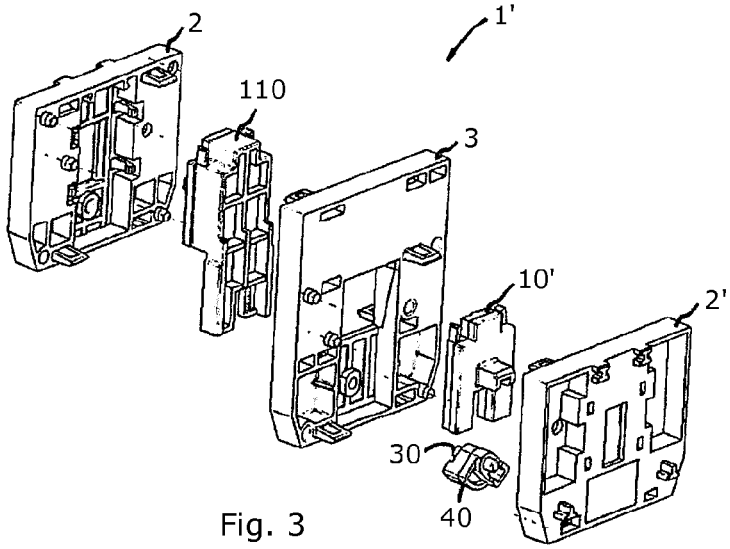
FIG. 3 shows an exploded view of an interlock mechanism, according to a second embodiment of the invention.
Figure 3A:
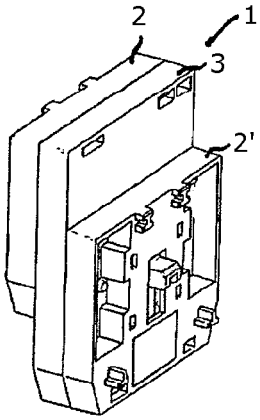
FIG. 3A shows a perspective view of the interlock mechanism shown in FIG. 3, wherein the elements of the interlock are assembled together.
Figure 4:
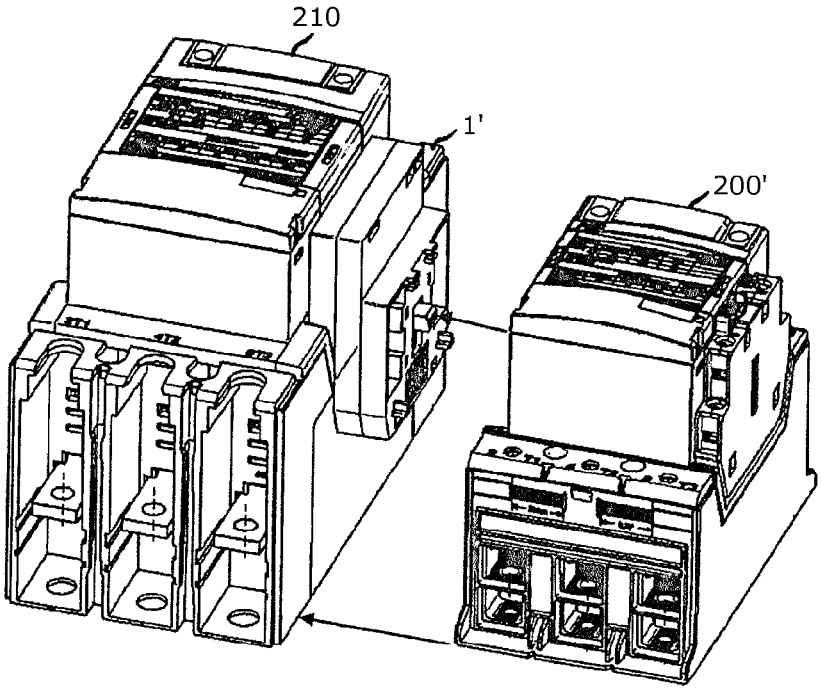
FIG. 4 shows a perspective view of two switching devices of different size with the interlock mechanism shown in FIG. 3 mounted in between these two devices.

With reference to FIGS. 3, 3*a* and 4, to be able to interlock switching devices of different size, a third housing 3 is provided to be arranged between the first and the second housings 2, 2'. The first sliding bar 110 is further adapted to the size of the first switching device 210. In this way, switching devices 210, 200' of different sizes may be interlocked by the interlock 1'.

Optionally, a snap catch 15 is provided and protrudes inwards from one edge of the housing and is arranged to be cooperated with the snap hook 16 arranged on the other end of the sliding bar. This snap-fit joint enables a non-movable sliding bar at installation and connection of the interlock 11' with the switching devices 200/210, 200' and therefore allows an easy installation. Both the snap catch 15 and the snap hook are made of flexible material, for example thermoplastics, that will be deflected briefly during joining operation. It is understood that other kinds of snap-fit joints may be also applicable.

Further advantages of the invention are easily installation, compact size, ease of manufacturing due to less components, and therefore less production cost.

What is claimed is:

1. An interlocking mechanism for interlocking a first and a second low voltage switching devices, wherein each of the switching devices comprises a movable contact part, a stationary contact part and an actuating unit for operating the movable contact part in a direction and making connection or disconnection with the stationary contact part, the interlocking mechanism comprising a first and a second housing connected to each other, a first and a second sliding bar, wherein the first sliding bar is arranged on the first housing and connecting to the actuating unit of the first switching device, wherein the second sliding bar is arranged on the second housing and connecting to the actuating unit of the second switching device, and wherein a sliding plane is defined and has an X- and Y-axis, the Y-axis being defined in the direction of motion of the actuating unit of the switching devices, and wherein each of the sliding bars are configured to slide in the Y-axis direction of the sliding plane, a shaft disposed between the first and the second housings, and a cam configured to be rotatable about the shaft when both switching devices are in open positions, characterized in that the shaft is disposed to be perpendicular to the sliding plane so that the shaft is perpendicular to the direction of motion of the actuating unit of the switching devices, the cam further comprises a first and a second locking element for blocking the first and second sliding bar respectively, each of the locking elements protruding laterally in the X-axis direction, each of the sliding bars comprises an opening at one end of the bar, and the opening is configured for retaining the corresponding locking element when the corresponding switching device is in a closed position.

2. The interlocking mechanism according to claim 1, wherein the cam is formed with the shaft as one piece.

3. The interlocking mechanism according to claim 1, wherein the cam is mountable on the shaft.

4. The interlocking mechanism according to claim 1, wherein the cam has a curved outline.

5. The interlocking mechanism according to claim 1, wherein the first and second housing comprises a holder respectively for holding the shaft.

6. The interlocking mechanism according to claim 1, wherein, when in use, the interlock mechanism is arranged between the first and the second switching devices.

7. The interlocking mechanism according to claim 6, wherein the first and the second switching devices are identical.

8. The interlocking mechanism according to claim 7, further comprising a third housing arranged between the first and second housings.

9. The interlocking mechanism according to claim 8, wherein the third housing and the first sliding bar are adapted to the size of the first switching device.

10. The interlocking mechanism according to claim 9, wherein the first and the second switching devices are of different size.

11. The interlocking mechanism according to claim 1, wherein each of the housings comprises a sliding track and the corresponding sliding bar is arranged to slide thereon.

* * * * *